US006220755B1

(12) United States Patent
Brown et al.

(10) Patent No.: US 6,220,755 B1
(45) Date of Patent: Apr. 24, 2001

(54) STACKABLE FLEXIBLE INTERMEDIATE BULK CONTAINER HAVING CORNER SUPPORTS

(75) Inventors: Bobby Glenn Brown, Denison; Bradley Matthew Eisenbarth; Craig Alan Nickell, both of Sherman, all of TX (US)

(73) Assignee: B.A.G. Corp., Dallas, TX (US)

( * ) Notice: Subject to any disclaimer, the term of this patent is extended or adjusted under 35 U.S.C. 154(b) by 0 days.

(21) Appl. No.: 09/458,362

(22) Filed: Dec. 9, 1999

(51) Int. Cl.[7] ..... B65D 33/02
(52) U.S. Cl. ..... 383/119; 383/109; 383/903
(58) Field of Search ..... 383/105, 109, 383/119, 903, 38; 220/9.1, 9.2

(56) References Cited

U.S. PATENT DOCUMENTS

| | | | | |
|---|---|---|---|---|
| 4,901,885 | * | 2/1990 | Boots . | |
| 4,903,859 | * | 2/1990 | Derby et al. | 383/109 X |
| 5,025,925 | * | 6/1991 | Wiklund | 383/119 X |
| 5,071,025 | * | 12/1991 | Boots | 383/119 X |
| 5,158,369 | * | 10/1992 | Derby | 383/119 X |
| 5,222,812 | * | 6/1993 | Cuddy et al. | 383/119 X |
| 5,289,937 | * | 3/1994 | Boots | 220/9.1 |
| 5,316,387 | * | 5/1994 | Polett et al. | 383/119 |
| 5,323,922 | * | 6/1994 | Lapoint, Jr. et al. | 383/119 X |
| 5,328,267 | * | 7/1994 | Cuddy et al. | 383/105 X |
| 5,328,268 | * | 7/1994 | Lafluer | 383/119 |
| 5,423,611 | * | 6/1995 | Sherrard | 383/119 X |
| 5,468,528 | * | 11/1995 | Schnaars et al. | 383/109 X |
| 5,556,205 | * | 9/1996 | Gallie et al. | 383/105 X |
| 5,564,833 | * | 10/1996 | Proffitt | 383/105 X |
| 5,649,767 | * | 7/1997 | Nickell et al. | 383/105 X |
| 5,664,887 | * | 9/1997 | LaFleur | 383/119 |
| 5,685,644 | * | 11/1997 | Taylor | 383/109 X |
| 5,857,778 | * | 1/1999 | Ells | 383/119 X |
| 5,873,655 | * | 2/1999 | Echeverria | 383/119 |
| 5,897,211 | * | 4/1999 | Hafer et al. | 383/119 |
| 6,000,549 | | 12/1999 | Perkins | 206/596 |
| 6,000,604 | * | 12/1999 | Lapoint, III | 383/119 X |
| 6,004,035 | | 12/1999 | Hafer et al. | 383/119 |
| 6,015,057 | | 1/2000 | Stone et al. . | |

FOREIGN PATENT DOCUMENTS

| | | | | |
|---|---|---|---|---|
| 441720 | * | 8/1991 | (EP) | 383/38 |
| 552845 | * | 7/1993 | (EP) | 220/9.1 |
| 2394390 | * | 2/1979 | (FR) | 383/109 |
| 2634469 | * | 1/1990 | (FR) | 383/119 |
| 2639037 | * | 5/1990 | (FR) | 220/9.1 |
| 8900271 | * | 9/1990 | (NL) | 383/119 |
| 930006027 | * | 4/1993 | (WO) | 220/9.1 |
| PCT/IE96/00078 | | 12/1996 | (WO) . | |
| PCT/IE99/00115 | | 11/1999 | (WO) . | |

* cited by examiner

*Primary Examiner*—Stephen K. Cronln
*Assistant Examiner*—Robin A. Hylton
(74) *Attorney, Agent, or Firm*—Michael A. O'Neil

(57) ABSTRACT

A baffle-type bulk bag is reinforced with triangular support members positioned in the triangular corners of the bulk bag to facilitate stacking. The bulk bag may include double layer side walls having support panels received therein.

15 Claims, 7 Drawing Sheets

STACKABLE FLEXIBLE INTERMEDIATE BULK CONTAINER HAVING CORNER SUPPORTS

TECHNICAL FIELD

The present invention relates generally to flexible intermediate bulk containers, also known as bulk bags, and more particularly to baffle-type bulk bags which are adapted for stacking one on top of another.

BACKGROUND AND SUMMARY OF THE INVENTION

Over the past thirty years flexible intermediate bulk containers, commonly known as bulk bags, have come into widespread use for receiving, storing, transporting, and discharging flowable materials of all types. Although circular bulk bags are known, bulk bags are typically constructed from rectangular panels which are sewn together along their adjacent edges to define a bulk bag which is initially square or rectangular in horizontal cross section. Nevertheless, all bulk bags, whether initially square, rectangular, or circular in cross section tend to assume a circular configuration when filled due to the uniform pressure imposed by the contents of the bulk bag against the flexible fabric side walls thereof.

U.S. Pat. No. 4,903,859 discloses a bulk bag comprising four double layer side walls. Stiffeners formed from cardboard are inserted between the layers of the side walls thereby imparting sufficient rigidity to the container to permit its use with liquids. Although the bulk bag of the '859 patent has been generally well received, its utilization has been somewhat limited by the fact that it cannot be stacked.

Co-pending application Ser. No. 09/390,403 assigned to the assignee hereof (doing business as Composite Container Corp.) discloses an improvement over the bulk bag of the '859 patent. In application Ser. No. 09/390,403 there is disclosed a bulk bag having double layer side walls and vertically extending corner pockets. Plywood sheets are received between the layers of the side walls and wooden posts are received in the corner pockets to provide a bulk bag suitable for use with liquids which is stackable.

U.S. Pat. No. 5,076,710 discloses a baffle-type bulk bag wherein bridge panels or baffles are sewn across the four corners of a nominally rectangular bulk bag. The baffles prevent the side walls of the bulk bags from bulging outwardly when the bulk bag is filled, thereby retaining the filled bulk bag in a more or less rectangular cross-sectional configuration. The baffles may be provided with apertures which allow material to flow into and out of the corners of the bulk bag during filling and discharging operations.

The present invention comprises an improvement over the prior art as defined by the '859 and '710 patents and application Ser. No. 09/340,403 to provide a baffle-type bulk bag which is stackable. In accordance with the broader aspects of the invention, triangular stiffeners are provided in the triangular corners of baffle-type bulk bags. The stiffeners may be formed from various materials including plastic panels, panels formed from corrugated paperboard and similar materials, etc. The stiffeners may be provided with apertures aligned with the apertures of the baffles thereby permitting the flow of material into and out of the bulk bag during filling and discharging operations.

In accordance with another aspect of the invention, baffle-type bulk bags may be provided with double layer side walls extending between the baffles. In such instances, stiffeners may be employed in the side walls of the bulk bag in addition to the stiffeners that are utilized in the triangular corners defined by the baffles.

In accordance with yet another aspect of the invention, there is provided an eight piece bulk bag side wall construction. An outer layer comprises four rectangular sections which are joined along seams disposed at the midpoints of the side walls of the bulk bag. An inner layer also comprises four sections which are similarly joined by seams located at the midpoints of the bulk bag side walls. The inner and outer layers are in turn joined by vertically extended seams located adjacent the corners of the bulk bag thereby defining the baffles and the double layer side walls of the bulk bag.

BRIEF DESCRIPTION OF THE DRAWINGS

A more complete understanding of the invention may be had by reference to the following Detailed Description when taken in conjunction with the accompanying Drawings, wherein.

DETAILED DESCRIPTION

Figure 1:
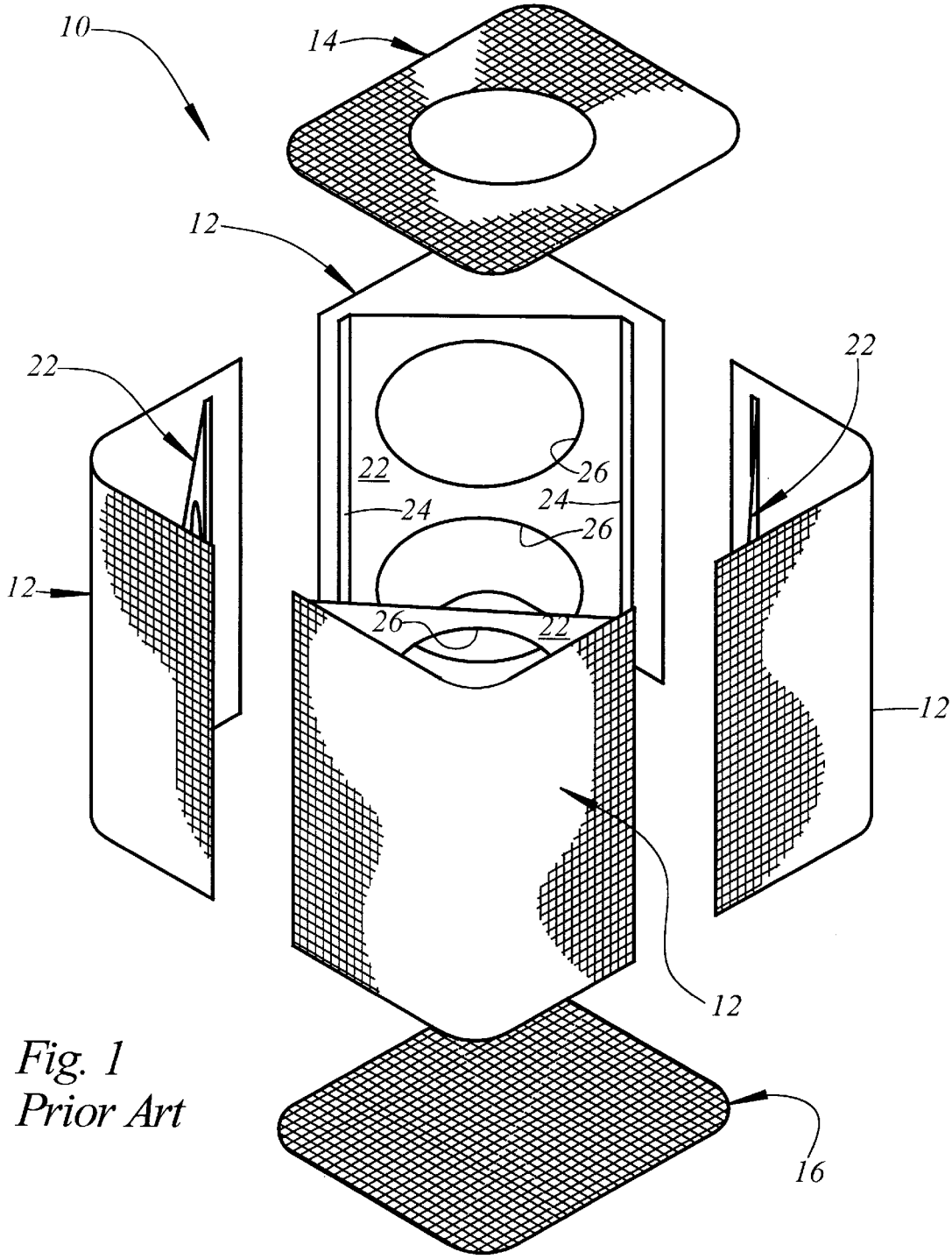
Fig. 1 Prior Art
FIG. 1 is an exploded perspective view of a prior art baffle-type bulk bag.

Referring now to the Drawings, and particularly to FIG. 1 thereof, there is shown a baffle-type bulk bag 10 of the type disclosed in U.S. Pat. No. 5,076,710 granted Dec. 31, 1991 to the assignee hereof. The bulk bag 10 comprises four side panels 12, a top panel 14, and a bottom panel 16. As will be appreciated by those skilled in the art, the top panel 14 may be provided with various types and kinds of fill chutes or spouts depending upon the requirements of particular applications of the invention. Likewise, the bottom panel 16 may be provided with various types and kinds of discharge chutes or spouts, or may comprise a plain bottom as shown, depending upon the requirements of particular application of the invention.

Figure 2:
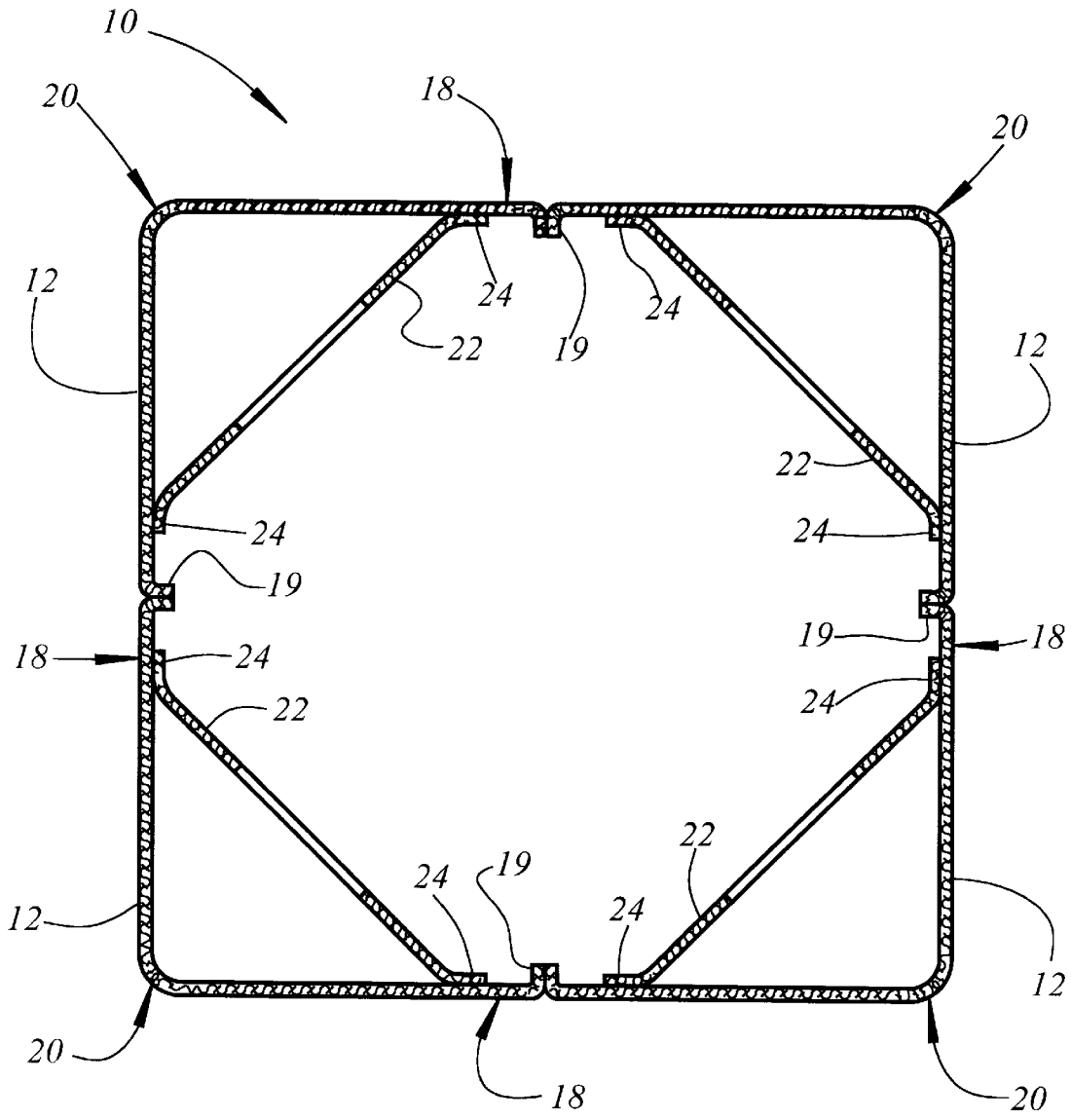
Fig. 2 Prior Art
FIG. 2 is a horizontal sectional view of the baffle-type bulk bag of FIG. 1.

The bulk bag 10 is further illustrated in FIG. 2. In its assembled configuration, the bulk bag 10 comprises four side walls 18 which are formed by joining adjacent side panels 12 along vertically extending seams 19 located at the midpoints of the side walls 18. The bulk bag 10 further comprises four corners 20.

A baffle 22 extends across each corner 20 of the bulk bag 10. The baffles 22 prevent the side walls 18 of the bulk bag 10 from bulging outwardly when the bulk bag 10 is filled, thereby retaining the filled bulk bag in a generally rectangular configuration. The baffles 22 are secured to the side panels 12 of the bulk bag by vertically extending seams 24. Referring simultaneously to FIGS. 1 and 2, the baffles 22 may be provided with apertures 26 to facilitate movement of material into and out of the corners of the bulk bag during filling and discharging operations.

Figure 3:
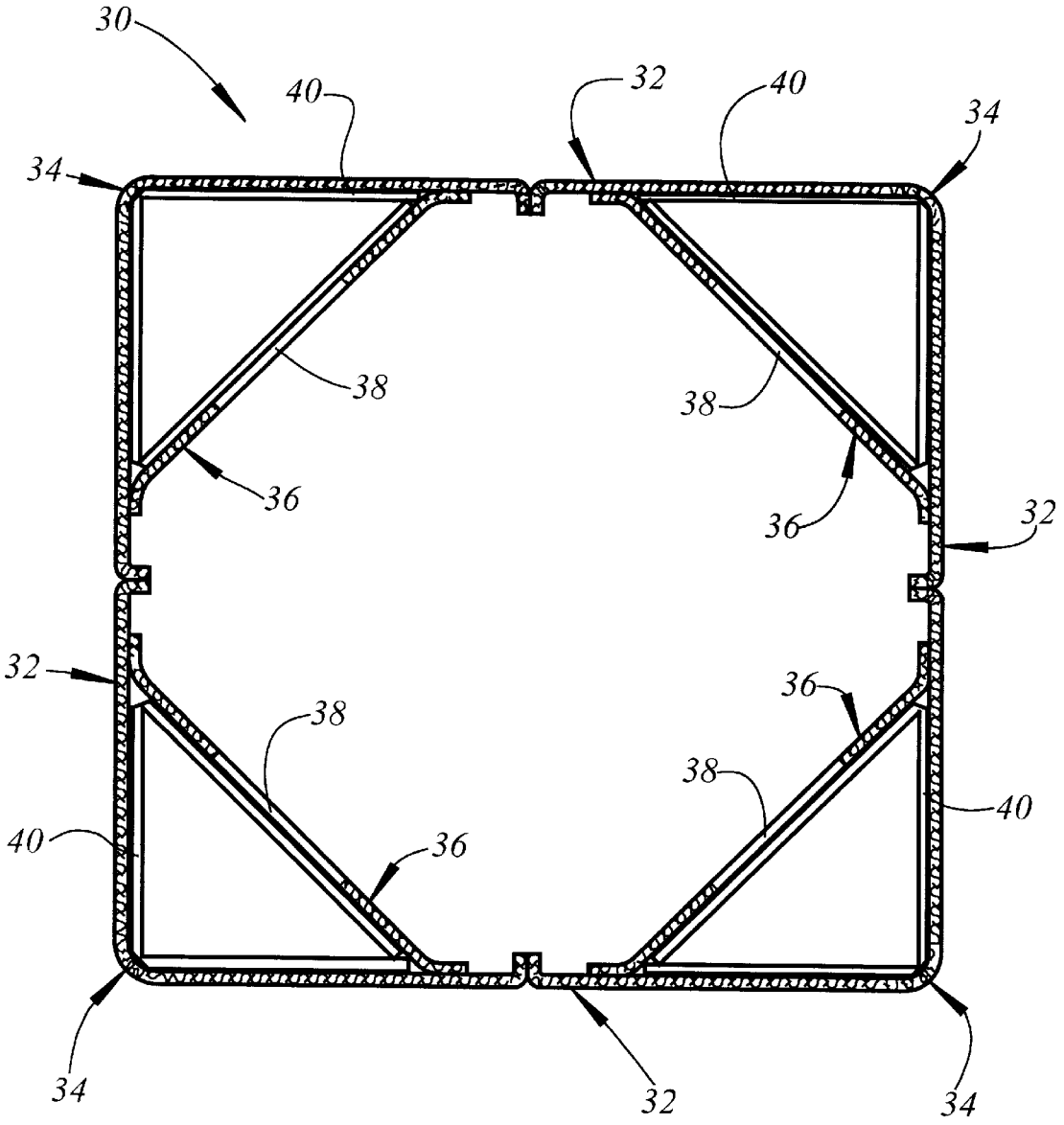
FIG. 3 is a view similar to FIG. 2 illustrating a first embodiment of the invention.

Referring to FIG. 3, there is shown a baffle-type bulk bag 30 incorporating a first embodiment of the invention. The bulk bag 30 is constructed similarly to the bulk bag 10 illustrated in FIGS. 1 and 2 and described hereinabove in conjunction therewith. Thus, the bulk bag 30 comprises four side walls 32 which intersect at four corners 34. A baffle 36 extends across each corner 34. The baffles 36 may be provided with apertures 38 to facilitate the flow of material into and out of the triangular corners defined by the baffles during bulk bag filling and discharging operations.

In accordance with the present invention, each of the triangular corners of the bulk bag 30, as defined by the baffles 36, is provided with a stiffener 40. The stiffeners 40 are preferably triangular in cross section and dimensioned to closely match the dimensions of the triangular corners of the bulk bag. The vertical dimensions of the stiffeners 40 are matched to the height of the bulk bag in which they are used, that is, the stiffeners 40 extend the entire distance between the upper and lower edges of the side walls 32 of the bulk bag 30.

The use of the stiffeners of the present invention in baffle-type bulk bags is highly advantageous in that it allows the bulk bags to be stacked. In this manner a substantially greater number of bulk bags can be received within a particular vehicle, warehouse, etc. than would be the case if the bulk bags are not stacked. By means of the invention, bulk bags can be stacked one upon another to a total height of three or more bulk bags depending upon the characteristics of the materials that are received within the bulk bags.

Figure 4:
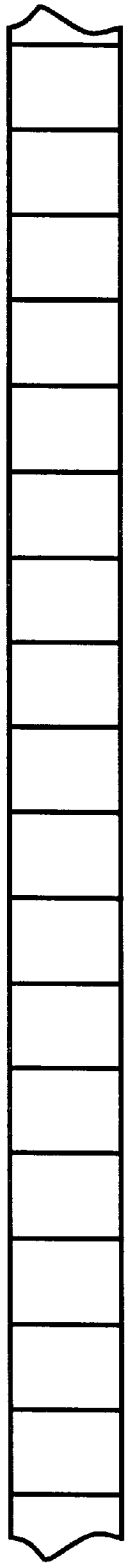
FIG. 4 is a cross section of a plastic panel useful in the practice of the invention.
Figure 5:
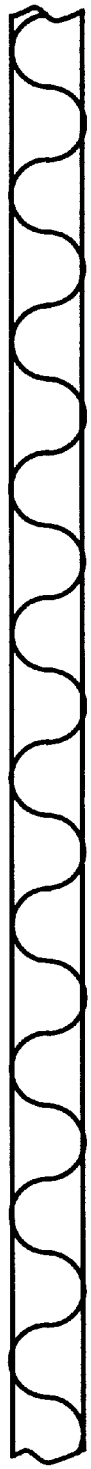
FIG. 5 is a cross section of a corrugated panel useful in the practice of the invention.

The stiffeners 40 of the present invention may be manufactured from plastic panels of the type sold by Coroplast of Dallas, Tex., under the trademark "COREX™". FIG. 4 illustrates the cross-sectional configuration of the "COREX" panels. Other types of plastic panels may also be used, depending upon the requirements of particular applications of the invention. The triangular stiffeners of the prevent invention may also be formed from corrugated materials of the type having cross sections such as shown in FIG. 5. Such panels may be formed from various types of paperboard, fiberboard, cardboard, and other materials, all of which are collectively referred to herein as "corrugated panels".

Figure 6:
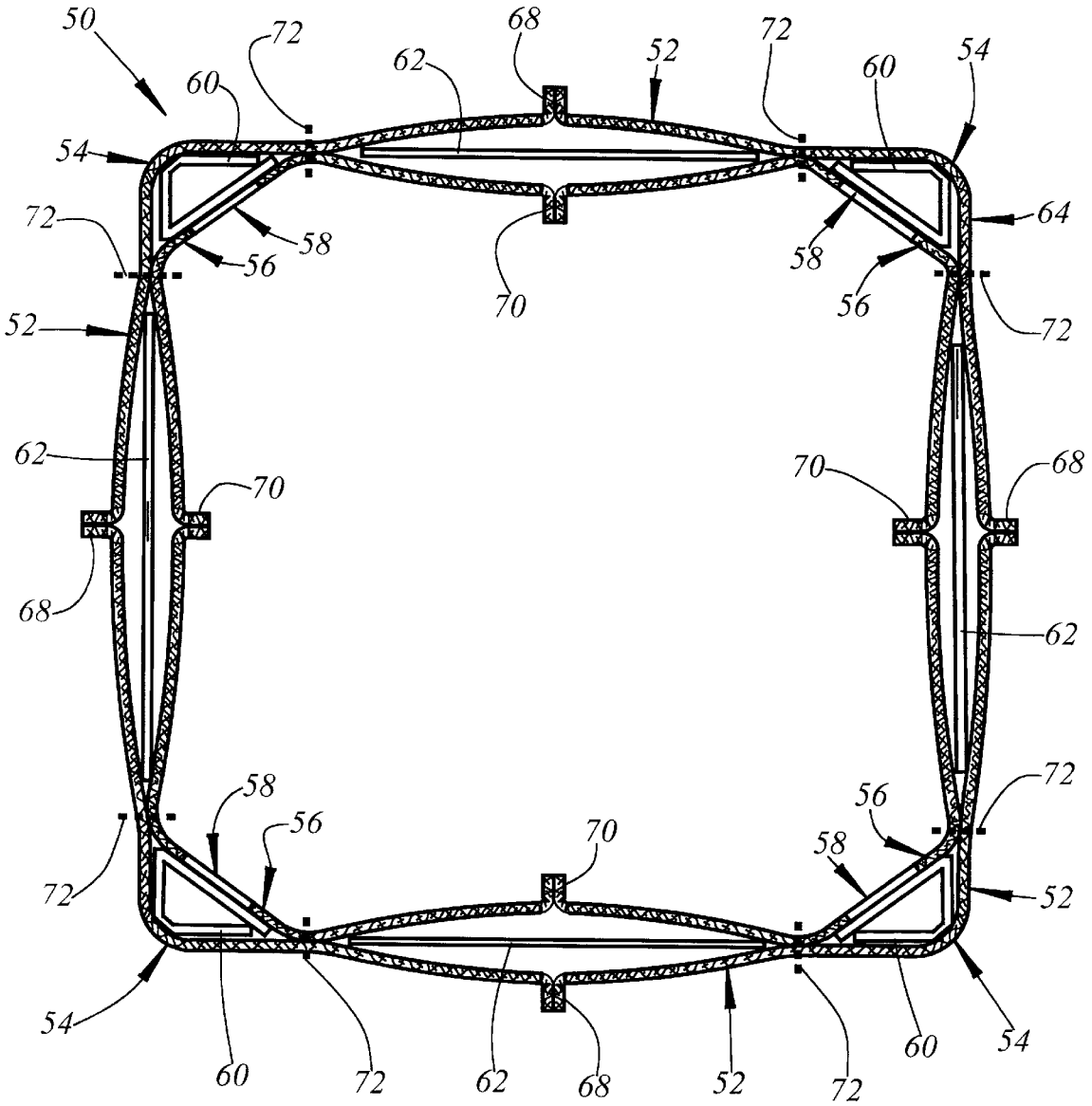
FIG. 6 is a horizontal sectional view of a bulk bag comprising a second embodiment of the invention.

Referring to FIG. 6, there is shown a bulk bag 50 incorporating a second embodiment of the invention. The bulk bag 50 comprises four side walls 52 which intersect at four corners 54. Baffles 56 extend across each of the corners 54. The baffles may be provided with apertures 58 to facilitate the movement of material into and out of the corners of the bulk bag 50 during filling and discharging operations.

In accordance with a second embodiment of the invention, triangular stiffeners 60 are positioned in each of the four corners of the bulk bag 50 as defined by the baffles 56. The triangular stiffeners 60 may be formed from various types of plastic panels, particularly including the plastic panels sold by Coroplast of Dallas, Tex., and identified by that company by the trademark "COREX™". Alternatively, the triangular stiffener 60 may be formed from other types of plastic panels or from panels formed from corrugated materials such as paperboard, fiberboard, cardboard, and the like all of which are collectively referred to herein as "corrugated panels". Other types and kinds of materials may also be used in the fabrication of the triangular stiffener 60 depending upon the requirements of particular applications of the invention.

The bulk bag 50 of FIG. 6 differs from the bulk bag 30 of FIG. 3 in that the side walls 52 thereof comprise double layer side walls. Stiffeners 62 are provided in each of the double layer side walls 52 comprising the bulk bag 50. The stiffener 62 may be formed from plastic panels of the type sold by Coroplast of Dallas, Tex., under the trademark "COREX™" or from other types of plastic panels. Alternatively, the stiffener 62 may be corrugated panels as such term is hereinabove defined. Other types and kinds of materials may be utilized in the fabrication of the stiffeners 62 depending upon the requirements of particular applications of the invention.

The use of the stiffeners 62 in addition to the stiffener 60 as illustrated in FIG. 6 is advantageous in that it further improves the stackability of baffle-type bulk bags incorporated in the invention. In this manner, a greater number of bulk bags can be stacked one upon another than would otherwise be possible. Alternatively, bulk bags containing denser materials may be stacked one upon another.

FIG. 6 further illustrates a third embodiment of the invention. In accordance with the third embodiment, an eight piece bulk bag side panel construction is provided. As is illustrated in FIG. 6, such construction provides bulk bag side walls which include both baffles extending across the corners of the bulk bag and double layer side walls extending between the baffles.

The side walls 52 of the bulk bag 50 are defined by an outer side wall panel 64 and an inner side wall panel 66. The outer side wall panel comprises four pieces which are joined together by seams 68 located at the midpoints of the side walls 52. The inner side wall panel is likewise comprised of four pieces which are joined together by seams 70 positioned opposite the seams 68. The outer side wall panel 64 is connected to the inner side wall panel 66 by eight seams 72 thereby forming the baffles 56 and the double layer side walls of the bulk bag 50. The seams 72 are vertically disposed and preferably extend continuously between the upper and lower edges of the side walls 52.

Figure 7:
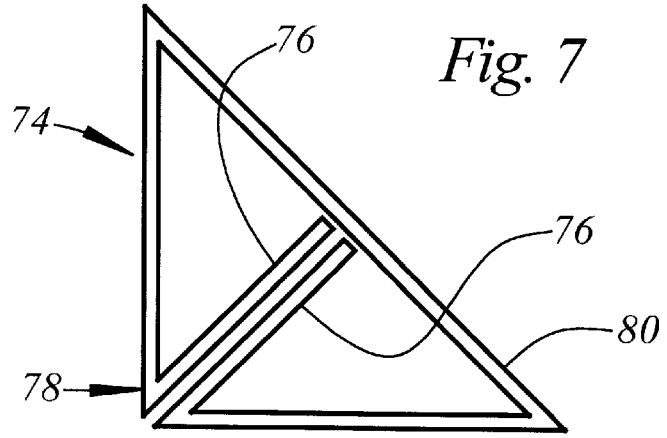
FIG. 7 is a top view illustrating a first variation of the triangular support of the present invention.
Figure 8:
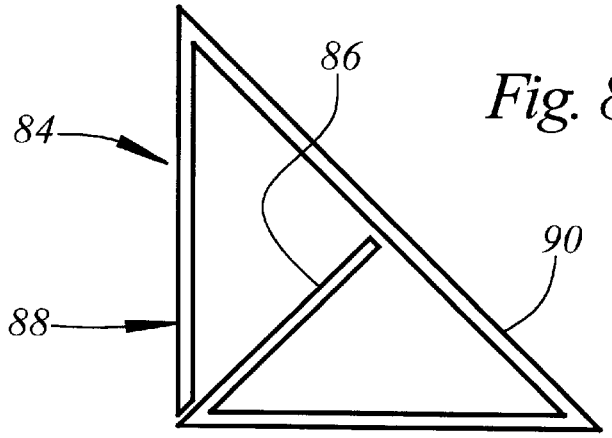
FIG. 8 is a top view illustrating a second variation of the triangular support of the present invention.
Figure 9:
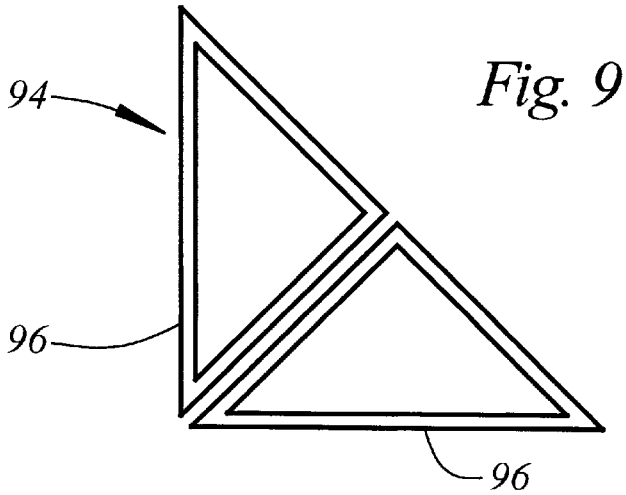
FIG. 9 is a top view illustrating a third variation of the triangular support of the present invention.

FIGS. 7, 8, and 9 illustrate variations of the construction of the stiffeners 60 illustrated in FIG. 6 and described hereinabove in conjunction therewith. Referring particularly to FIG. 7, there is shown a triangular stiffener 74 having reinforcing panels 76 extending inwardly from the apex 78 of the triangular configuration to points adjacent the long leg 80 thereof. The panels 76 provide additional support which further facilitates the stacking of flexible intermediate bulk containers incorporated in the present invention.

FIG. 8 illustrates a triangular stiffener 84 having a single panel 86 extending inwardly from the apex 88 of the triangular configuration to a point adjacent the long leg 90 thereof. FIG. 9 illustrates a triangular stiffener configuration 94 comprising separate triangles 96 which are positioned adjacent one another to form the triangular stiffener 94. Other configurations of the triangular stiffeners of the present invention will suggest themselves to those skilled in the art.

Figure 10:
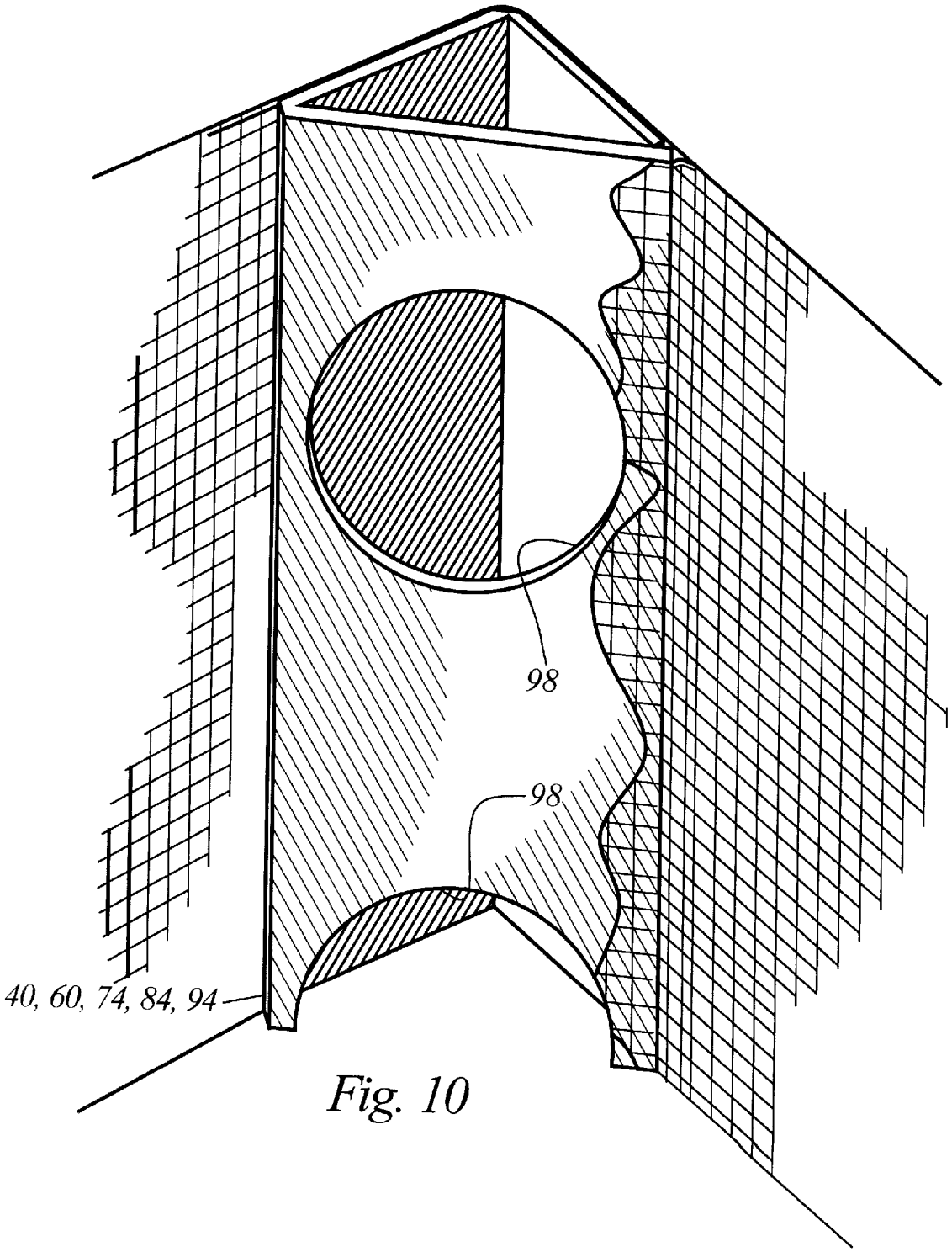
FIG. 10 is perspective view of a triangular support member useful in conjunction with the embodiments of the invention illustrated in FIGS. 3 and 6.

FIG. 10 further illustrates the triangular stiffeners 40, 60, 74, 84, and 94 as illustrated in FIGS. 3 and 6 through 9 and described hereinabove in conjunction therewith. The triangular stiffeners of the present invention may be provided with apertures 98 which are aligned with the apertures 38 of the baffles 36 of the bulk bag 30 shown in FIG. 3 and with the apertures 58 of the baffle 56 of the bulk bag 50 shown in FIG. 6. When employed the apertures 98 facilitate the movement of material into and out of the triangular corners of the bulk bag during bulk bag filling and discharging operations. FIG. 10 further illustrates the height of the stiffeners 40, 60, 74, 84, and 94 as being substantially identical to the height of the side walls of the bulk bag in which the stiffeners are used.

It will therefore be understood that the present invention comprises an improved baffle-type bulk bag construction wherein triangular stiffeners are provided in the triangular corners of baffle-type bulk bags as defined by the baffles thereof. Bulk bags incorporating the invention may also be provided with double layer side walls extending between the baffles which receive stiffener panels to further enhance the stackability of the bulk bags. The invention further provides an eight piece bulk bag side wall construction which provides both baffles extending across the corners of the bulk bag and double layer side walls extending between the baffles.

Although preferred embodiments of the invention have been illustrated in the accompanying drawings and described in the foregoing Detailed Description, it will be understood that the invention is not limited to the embodiments disclosed, but is capable of numerous rearrangements, modifications, and substitutions of parts and elements without departing from the spirit of the invention.

What is claimed is:

1. In combination with a baffled, bulk bag of the type comprising side walls extending to corners and baffles extending across the corners for maintaining the bulk bag in a relatively rectangular configuration when filled, the improvement which comprises:

triangular support members substantially filling the triangular corners of the bulk bag defined by the baffles thereof and having a vertical dimension substantially coincident with the vertical dimension of the bulk bag and comprising three substantially planar, substantially rigid panels positioned edge-to-edge in a triangular array and joined along at least two adjacent edges.

2. The improvement according to claim 1 wherein the triangular support members are formed from plastic panels.

3. The improvement according to claim 1 wherein the triangular support members are formed from corrugated panels.

4. The improvement according to claim 1 wherein the triangular support members contain apertures aligned with apertures of the baffles.

5. In combination with a baffled, bulk bag of the type comprising double layer side wall portions and baffles extending across the corners for maintaining the bulk bag in relatively rectangular configuration when filled, the improvement which comprises:

triangular support members substantially filling the triangular corners of the bulk bag defined by the baffles and comprising three substantially planar substantially rigid panels positioned edge-to-edge in a triangular array and joined along at least two adjacent pages;

stiffeners positioned in the double layer portions of the side walls.

6. The improvement according to claim 5 wherein the triangular support members are formed from plastic panels.

7. The improvement according to claim 5 wherein the triangular support members are formed from corrugated panels.

8. The improvement according to claim 5 wherein the triangular support members contain apertures aligned with apertures of the baffles.

9. A flexible container for receiving, transporting, and storing flowable materials comprising:

a substantially continuous inner side wall layer;

a substantially continuous outer side wall layer;

eight vertical seams joining the inner and outer side wall layers to form baffles extending across corners and double layer side walls extending between the baffles;

stiffeners within the double layer side walls; and triangular support members within the corners and comprising three substantially planar, substantially rigid panels positioned edge-to-edge in a triangular array and joined along at least two adjacent edges.

10. The improvement according to claim 9 wherein the triangular support members substantially fill the triangular corners of the bulk bag defined by the baffles and have a vertical dimension substantially coincident with the vertical dimension of the bulk bag.

11. The improvement according to claim 10 wherein the triangular support members are formed from plastic panels.

12. The improvement according to claim 10 wherein the triangular support members are formed from corrugated panels.

13. The improvement according to claim 10 wherein the triangular support members contain apertures aligned with apertures of said baffles.

14. The improvement according to claim 9 wherein the stiffeners are formed from plastic panels.

15. The improvement according to claim 9 wherein the stiffeners are formed from corrugated panels.

* * * * *